United States Patent [19]

Moore

[11] 4,377,411

[45] Mar. 22, 1983

[54] ADDITION AGENT FOR CAST IRON

[76] Inventor: William H. Moore, Whitehall Apts.-6E, Whitehall Rd., Chattanooga, Tenn. 37405

[21] Appl. No.: 299,711

[22] Filed: Sep. 8, 1981

[51] Int. Cl.[3] ..... C22C 33/00

[52] U.S. Cl. ..... 420/578; 75/53; 75/123 L; 75/130 L; 420/581

[58] Field of Search ..... 75/53, 130 R, 134 S, 75/123 L

[56] References Cited

U.S. PATENT DOCUMENTS

| | | | |
|---|---|---|---|
| 2,767,084 | 10/1956 | Chandler | 75/134 S |
| 2,950,187 | 8/1960 | Ototani | 75/134 S |
| 3,215,525 | 11/1965 | Sprankle | 75/134 S |

*Primary Examiner*—P. D. Rosenberg
*Attorney, Agent, or Firm*—Woodling, Krost & Rust

[57] ABSTRACT

An inoculating alloy for addition to molten cast iron is disclosed. The composition is a silicon ferro alloy containing five to eight percent calcium as its active ingredient.

5 Claims, No Drawings

ADDITION AGENT FOR CAST IRON

My invention relates to an additive agent sometimes known as an inoculating alloy which is added to molten iron of cast iron composition in order to improve the qualities of said cast iron.

BACKGROUND OF THE INVENTION

The inoculation process has been used in making cast iron for more than 60 years and usually consists of adding a silicon alloy containing calcium, magnesium, strontium, barium, cerium, aluminum or other active ingredients, singly or in combination, directly to the molten metal either prior to or during the casting operation. Of all the inoculating alloys those containing calcium are the most popular because calcium appears to be the most versatile active ingredient.

Alloys of calcium and silicon, especially calcium silicide and calcium bearing ferro silicon, are well known and have been in continued use as inoculating agents by those skilled in the art of making cast iron. Calcium silicide is an alloy containing approximately 30% calcium with silicon approximately 60% and the balance iron. Calcium bearing ferro silicon is an alloy usually containing ½% or up to about 2% of calcium with the balance being iron and silicon.

Other alloys have been used at various times, containing greater or lesser quantities of calcium, but these are not in general use for the specific purpose of inoculating or nucleating cast iron.

Calcium has a limited solubility in molten cast iron and tends to form copious quantities of refractory slag when added as a metal to molten cast iron. By the same token, when using calcium silicon containing usually about 20–35% calcium, it is not possible to get all calcium into solution and relatively large quantities of slag are formed. Such an alloy is wasteful of calcium, which increases the price of the alloy considerably. On the other hand, alloys such as calcium bearing ferro silicon do not allow sufficient calcium into the molten cast iron because this concentration of calcium is too low.

SUMMARY OF THE INVENTION

I have discovered that an alloy containing 5–8% calcium with 45 or more percent silicon, and the balance essentially iron, is particularly effective for introducing calcium into the metal in sufficient amount without producing excessive amounts of refractory calcium slag as a by-product of the addition. In general, the molten cast iron to which my alloy has been added is exceptionally clean and fluid. The amount of calcium in my alloy does not lead to ususual amounts of slag or dross, whereas higher calcium contents of about 20% or more do on the average result in metal that exhibits a greater propensity to slag and dross defects in castings.

Accordingly, this invention has for an object an improved silicon calcium alloy for adding to molten cast iron.

Another object is an alloy that reduces the chill value of cast iron by graphitizing action.

Another object is an alloy that increases the eutectic cell count of a cast iron.

Another object is an alloy that deoxidizes a cast iron without forming excessive quantities of slag.

Another object is an alloy that increases the tensile strength of a cast iron.

Another object is an alloy that improves the graphite structure of a cast iron.

Still other objects of this invention will be apparent on reading this specification in which I describe my new calcium silicon alloy.

DETAILED DESCRIPTION AND METHOD OF PRACTICE OF THE INVENTION

My invention is an inoculating alloy in which calcium is the prime active ingredient, being present in a concentration of from 5 to 8 percent by weight, and in which silicon is present in a concentration of from 45 to 75 percent, the remainder being essentially iron. Herein, all percentages given are by weight.

While this alloy may also contain small quantities of other ingredients such as magnesium, aluminum, strontium, barium, and the like, I find that it should contain calcium only within the relatively narrow limits specified to be fully effective.

I prefer to keep the silicon content of my alloy at a greater value than 45%, because silicon is a useful graphitizer and a vehicle for the introduction of calcium. While the silicon content of the alloy is not critical, it appears to be more economical to keep the silicon content generally in the range of 45–75%. The balance of the alloy composition is usually iron and if this is too high (about 50% or more) the alloy tends to cool the molten cast iron to which it is added by too great a degree. At higher silicon and lower iron contents, the alloy is more exothermic in nature and does not substantially lower the temperature of the metal to which it is added.

I have found that the addition of various elements in my alloy, along with calcium, such as magnesium, barium, zirconium, titanium, strontium and the like, do not seem to enhance the alloy in any particular manner. I prefer to confine the presence of such alloys to not more than about 1½% each, as they do not seem to be necessary or effective by themselves in such amounts. I have occasionally added other special metals, such as chromium, manganese, nickel, molybdenum and the like, to my alloy composition, but they seem to result only in the special effects usually attributed to such metals.

Aluminum usually is present in amounts up to 2% in my calcium alloy and seems to increase eutectic cell count to a greater number than when it is absent. I prefer, however, to limit the aluminum to this amount because of the chances of hydrogen pin holes often associated with larger amounts of aluminum in any alloy of this sort.

The alloy is prepared by any of the methods known to those skilled in the art. Its particle size should be the same as that of most commercial inoculants or metallic alloys which are added directly to molten cast iron outside of the furnace. Thus a size ranging from predominantly 8 mesh to predominantly ½" mesh is usually preferred.

The alloy is preferably added to molten metal as it is transferred from the furnace to the pouring ladle and the amount used is normally in the range of 20 ozs. per ton of metal to 120 ozs. per ton of metal. In special cases the alloy may be added to the metal stream as it is being poured into the mold or may even be placed in the gating system of the mold.

I have performed various tests of tensile strength, hardness and other properties on cast irons inoculated with the alloy of my invention. For example, in ones test, 80 ounces of the alloy of my invention was added to 2000 pounds of molten cast iron of the composition:

| | |
|---|---|
| Total Carbon | 3.10% |
| Silicon | 1.72% |
| Manganese | 0.82% |

A 1.2" diameter test bar was cast from the cast iron to which my alloy had been added and when cold, was subjected to a tensile test. The strength of this bar was found to be 54,500 psi with a brinell hardness value of 202. A similar test bar poured from a portion of this metal to which calcium bearing ferro silicon had been added exhibited a tensile strength of 42,300 psi at a brinell hardness value of 187. Examination of the structure of these test bars showed that the metal to which my alloy had been added contained uniformly dispersed and uniformly sized type "A" graphite with a random distribution. On the other hand, the test bar to which calcium bearing ferro silicon had been added showed graphite of mixed sizes and about 30% of Type "D" graphite.

In another comparison test, a large casting consisting of a flat plate 2'×3'×3" thick was cast from a cast iron to which had been added 60 ounces of calcium silicide containing 32% calcium. The upper surface of this casting contained particles of dross or slag in areas approximately 3" square and about ⅛" deep into the upper surface of the casting. A second portion of the same metal to which had been added 60 ounces of my alloy containing 6% calcium, was poured into another large casting of the same dimensions. This casting was exceptionally clean and free from any dross or slag on any casting surface.

I have found that this alloy reduces the chill value of molten cast iron substantially. In an actual test the chill value was reduced from 16/32nds on a standard chill wedge test to a value of 4/32nds on the same chill wedge test by an addition of 40 ounces per ton of metal treated. Morever, the chill value of 4/32nds did not climb higher than 5/32nds in a period of 15 minutes. This illustrates the staying power and the full deoxidizing behavior of this alloy. In this same test, the eutectic cell count in a 1" diameter test bar was increased rom 500 cells per square inch to a value exceeding 2,500 cells per square inch in a similar 1" diameter test bar.

Although the preferred method of the invention has been described, various modifications in the method or alloy of the invention will become apparent to those skilled in the art.

I claim:

1. An improved inoculating alloy for increasing the strength, fluidity and cleanliness of molten cast iron, containing calcium in the amount of 5.0–8.0%, with the balance consisting essentially of silicon and iron.

2. The alloy of claim 1 and in which the weight percent of silicon is restricted to the range of 45–75%.

3. The alloy of claim 2 and in which there is also present an aluminum content of between 0 and 2%, the balance being essentially iron.

4. A silicon ferro alloy for inoculating cast iron in which calcium is the prime active ingredient, consisting essentially of the following components with percents in the ranges given:

| | |
|---|---|
| Calcium | 5.0–8.0% |
| Silicon | 45–75% |
| Iron | Balance |

5. A silicon ferro alloy for inoculating cast iron in which calcium is the prime active ingredient, consisting essentially of the following components with percents in the ranges given:

| | |
|---|---|
| Calcium | 5.0–8.0% |
| Silicon | 45–75% |
| Aluminum | 0–2% |
| Iron | Balance |

* * * * *